US011918852B1

(12) United States Patent
Stearns et al.

(10) Patent No.: US 11,918,852 B1
(45) Date of Patent: Mar. 5, 2024

(54) CLIMBING EXERCISE APPARATUS

(71) Applicants: Kenneth W Stearns, Houston, TX (US); Joseph D Maresh, West Linn, OR (US)

(72) Inventors: Kenneth W Stearns, Houston, TX (US); Joseph D Maresh, West Linn, OR (US)

( * ) Notice: Subject to any disclaimer, the term of this patent is extended or adjusted under 35 U.S.C. 154(b) by 0 days.

(21) Appl. No.: 16/940,389

(22) Filed: Jul. 28, 2020

Related U.S. Application Data

(60) Provisional application No. 62/922,188, filed on Jul. 26, 2019.

(51) Int. Cl.
*A63B 22/20* (2006.01)
*A63B 22/00* (2006.01)

(52) U.S. Cl.
CPC ..... *A63B 22/205* (2013.01); *A63B 22/001* (2013.01); *A63B 2022/0043* (2013.01)

(58) Field of Classification Search
CPC ..... A63B 22/14; A63B 22/18; A63B 22/20; A63B 22/201; A63B 22/203; A63B 22/205; A63B 22/208; A63B 22/00; A63B 22/0002; A63B 22/0005; A63B 22/0007; A63B 22/001; A63B 22/0012; A63B 22/0015; A63B 22/0017; A63B 22/0025; A63B 22/0028; A63B 22/003; A63B 22/0033; A63B 22/0035; A63B 22/0038; A63B 22/0041; A63B 22/0043; A63B 22/04; A63B 22/06; A63B 22/0605; A63B 22/0664; A63B 22/0694; A63B 22/16; A63B 9/00; A63B 2009/002; A63B 2009/004; A63B 2009/006; A63B 2009/008; A63B 69/0048; A63B 21/00181; A63B 21/00185; A63B 21/005; A63B 21/0023; A63B 21/008; A63B 21/0083; A63B 21/0084; A63B 21/00845; A63B 21/0085; A63B 21/0087; A63B 21/088; A63B 21/012; A63B 21/040407; A63B 21/0414; A63B 21/0421; A63B 21/0428; A63B 21/0435; A63B 21/06; A63B 21/062; A63B 21/0609; A63B 21/0615; A63B 21/0617; A63B 21/0622; A63B 21/0624; A63B 21/0626; A63B 2022/0611; A63B 2022/0617; A63B 2022/0623; A63B 2022/0629; A63B 2022/0635; A63B 2022/0641; A63B 2022/0647;

(Continued)

(56) References Cited

U.S. PATENT DOCUMENTS 568,024 A * 9/1896 Gorman ..... A41D 13/085 74/551.8
3,381,958 A * 5/1968 Gulland ..... A63B 22/205 482/37

(Continued)

*Primary Examiner* — Megan Anderson
(74) *Attorney, Agent, or Firm* — Nick A Nichols, Jr.

(57) ABSTRACT

An exercise apparatus having homolateral and contralateral modes of operation may include a frame supporting generally vertically oriented reciprocating members. The reciprocating members may include foot supports secured at the lower distal ends thereof, and handlebars movably secured proximate the upper distal ends of the reciprocating members. The handlebars may be configured for homolateral and contralateral operation of the exercise apparatus.

12 Claims, 9 Drawing Sheets

(58) Field of Classification Search
CPC .... A63B 2022/0652; A63B 2022/0658; A63B 2022/067; A63B 2022/0676; A63B 2022/0682; A63B 2022/0688; A63B 23/00; A63B 23/02; A63B 23/0205; A63B 23/0211; A63B 23/0216; A63B 23/0222; A63B 23/0227; A63B 23/0233; A63B 23/0238; A63B 23/0244; A63B 23/035; A63B 23/03508; A63B 2023/0441; A63B 2023/0447; A63B 2023/0452; A63B 21/4034; A63B 21/4035; A63B 21/4045; A63B 23/0355; A63B 23/03575; A63B 23/03583; A63B 23/03591; A63B 2022/0043; A63B 22/0056; A63B 22/0058
USPC ..... 482/37, 52
See application file for complete search history.

(56) References Cited

U.S. PATENT DOCUMENTS 4,958,830 A * 9/1990 Huggins ..... A61H 1/0259 482/52
4,982,952 A * 1/1991 Wang ..... A63B 23/03583 482/53
5,000,441 A * 3/1991 Wang ..... A63B 22/0002 482/53
5,007,631 A * 4/1991 Wang ..... A63B 23/03583 482/52
5,037,088 A * 8/1991 Bernstein ..... A63B 23/12 482/8
5,040,785 A * 8/1991 Charnitski ..... A63B 22/205 482/52
D323,008 S * 1/1992 Wang ..... D21/670
5,090,690 A * 2/1992 Huang ..... A63B 22/0005 482/52
5,169,361 A * 12/1992 Hsu ..... A63B 22/205 482/53
5,199,932 A * 4/1993 Liao ..... A63B 22/001 482/37
5,222,927 A * 6/1993 Chang ..... A63B 22/205 482/53
5,295,927 A * 3/1994 Easley ..... A63B 21/015 482/52
D355,228 S * 2/1995 Hung ..... D21/670
5,492,515 A * 2/1996 Charnitski ..... A63B 22/205 482/37
5,679,100 A * 10/1997 Charnitski ..... A63B 22/001 482/37
5,928,115 A * 7/1999 Arroyo, Jr. ..... A63B 22/0605 482/62
5,997,445 A * 12/1999 Maresh ..... A63B 22/0664 482/70
6,135,923 A * 10/2000 Stearns ..... A63B 23/03583 482/52
6,183,397 B1 * 2/2001 Stearns ..... A63B 22/0017 482/52
6,485,395 B1 * 11/2002 Stearns ..... A63B 22/0012 482/52
6,814,690 B1 * 11/2004 Stearns ..... A63B 21/4047 482/52
7,041,035 B1 * 5/2006 Stearns ..... A63B 22/001 482/52
7,455,628 B1 * 11/2008 Stearns ..... A63B 22/001 482/52
8,647,241 B2 * 2/2014 Walton ..... A63B 22/0005 482/57
8,852,059 B1 * 10/2014 Stearns ..... A63B 22/001 482/52
8,926,474 B2 * 1/2015 Beal ..... A63B 23/1209 482/37
9,339,685 B1 * 5/2016 Maresh ..... A63B 22/0664
D759,169 S * 6/2016 Humberto Mercenari Uribe ..... D21/670
10,179,260 B1 * 1/2019 Stearns ..... A63B 21/4034
D842,939 S * 3/2019 Mercenari Uribe ..... D21/670
10,300,359 B1 * 5/2019 Isgar ..... A63B 53/14
10,315,069 B1 * 6/2019 Maresh ..... A63B 21/154
10,328,305 B1 * 6/2019 Maresh ..... A63B 23/0423
D853,502 S * 7/2019 Chen ..... D21/670
D853,504 S * 7/2019 Mercenari Uribe ..... D21/670
10,596,407 B1 * 3/2020 Maresh ..... A63B 24/0062
11,298,587 B2 * 4/2022 Silver ..... A63B 21/151
2006/0052225 A1 * 3/2006 Stearns ..... A63B 21/00072 482/121
2013/0210587 A1 * 8/2013 Shank ..... A63B 25/08 482/77
2015/0343259 A1 * 12/2015 Mercenari Uribe ... A63B 23/04 482/52
2019/0009129 A1 * 1/2019 Liao Lai ..... A63B 23/03591
2019/0160331 A1 * 5/2019 Mercenari Uribe . A63B 21/018
2019/0175982 A1 * 6/2019 Gearon ..... A63B 22/001
2019/0314667 A1 * 10/2019 Smith ..... A63B 21/4033
2020/0094106 A1 * 3/2020 Liu ..... A63B 21/4034
2020/0171346 A1 * 6/2020 Chen ..... A63B 22/205
2021/0291016 A1 * 9/2021 Zhou ..... A63B 21/0557

* cited by examiner

CLIMBING EXERCISE APPARATUS

CROSS-REFERENCE TO RELATED APPLICATION

This application claims priority to and the benefit of the filing date of U.S. Provisional Application Ser. No. 62/922,188, filed Jul. 26, 2019, which application is herein incorporated by reference in its entirety.

BACKGROUND

The present invention relates to fitness equipment, more particularly to exercise apparatus where the exercise paths are substantially vertical and parallel to each other.

During exercise machine climbing activities two coordinated body movements are generally possible. A first motion may be referred to as homolateral movement where an asymmetrical movement of the upper limb and the lower limb on the same side occurs, and a second motion referred to as contralateral movement where a diagonal movement of an upper limb with the opposite lower limb occurs. The first motion of homolateral movement or straight climbing is more closely correlated with martial arts where martial arts typically employ homolateral movements, whereas the second motion of asymmetrical or cross climbing action is more closely correlated with oppositional exercises such as swimming and walking. In homolateral motion the body halves do not cooperate but move separately, and in contralateral motion both sides of the brain function at the same time in a coordinated manner.

SUMMARY

An exercise apparatus having homolateral and contralateral modes of operation may include a frame supporting generally vertically oriented reciprocating members spaced apart and in substantial parallel relationship to one another. The reciprocating members may include foot supports fixedly secured at the lower distal ends thereof, and handlebars rotatably mounted proximate the upper distal ends of the reciprocating members. The handlebars may be selectively locked for homolateral and contralateral operation of the exercise apparatus.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
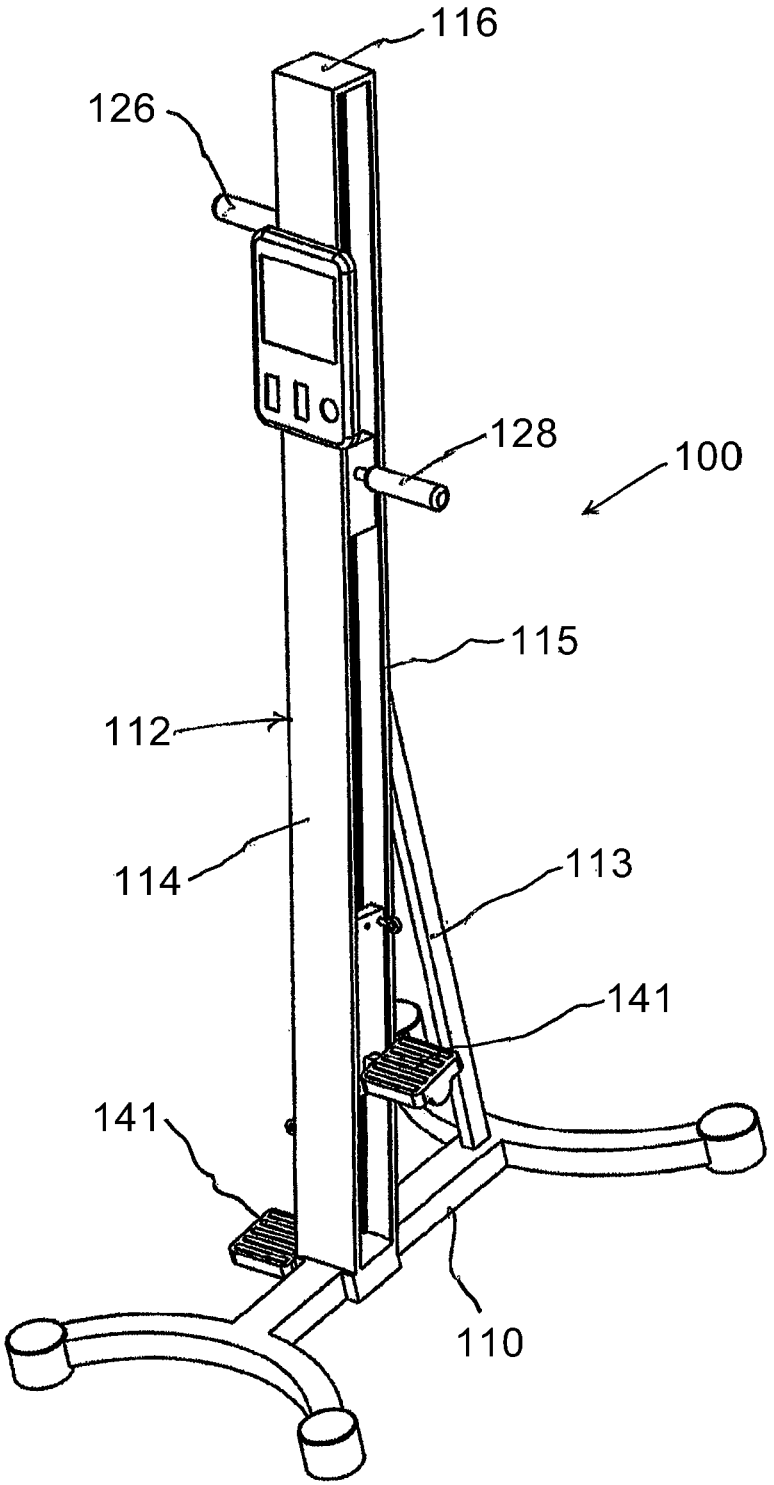
FIG. 1 is a perspective view of a climbing exercise apparatus.

Referring first to FIGS. 1-4, a climbing exercise apparatus is generally identified by the reference numeral 100. The apparatus 100 may include a base 110. A generally vertically extending stanchion 112 may be fixedly secured to the base 110. A brace member 113 having distal ends fixedly secure to the base 110 and the stanchion 112 may angularly support the stanchion 112. The stanchion 112 may extend upwardly from the base 110 an angle $\alpha$ of about fifteen (15°) degrees from vertical.

Figure 2:
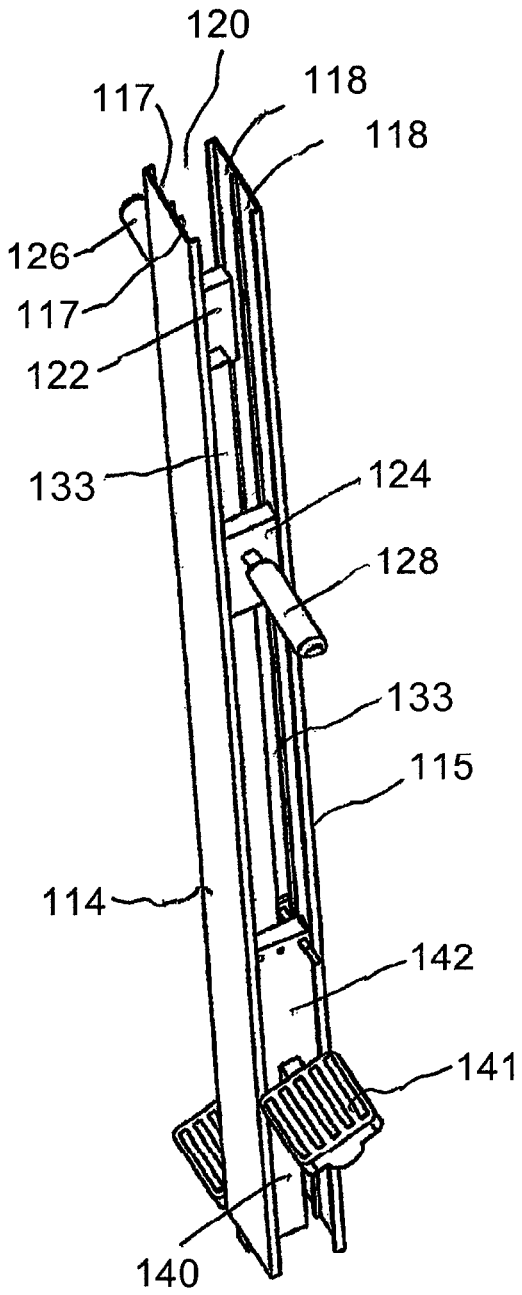
FIG. 2 is a partially broken away perspective view of the climbing exercise apparatus shown in FIG. 1.
Figure 3:
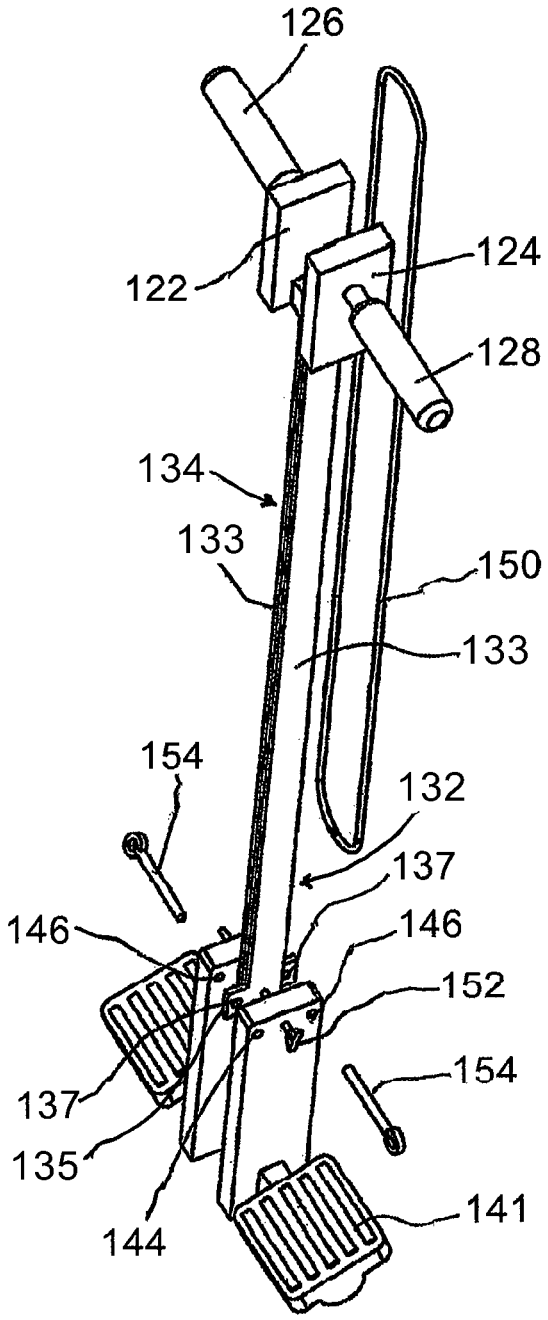
FIG. 3 is a perspective view showing the reciprocating members of the climbing exercise apparatus shown in FIG. 1.
Figure 4:
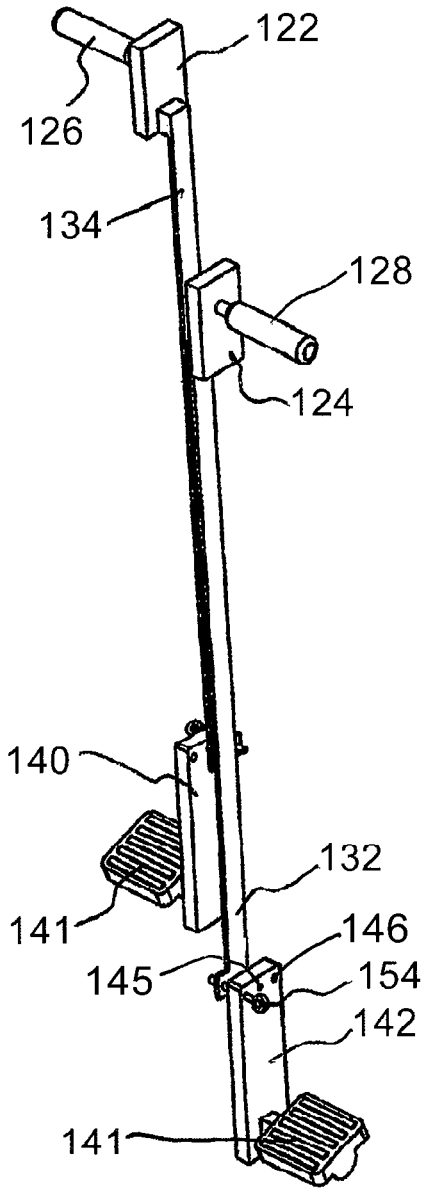
FIG. 4 is perspective view showing the reciprocating members of the climbing exercise apparatus of FIG. 1 configured in the straight climbing mode.

Referring now specifically to FIG. 2, the stanchion 112 may include spaced apart substantially parallel stanchion members 114 and 115. The lower ends of the stanchion 112 may be fixedly secured to the base 110 and the upper ends thereof connected by a bridge member 116 (shown in FIG. 1) to maintain the spacing between the stanchion members 114, 115. The stanchion members 114, 115 may include a pair of longitudinal stanchion races 117 and 118, respectively, in facing relationship to one another defining a gap 120 between the stanchion members 114, 115.

The climbing exercise apparatus 100 may include arm carriages 122 and 124 linearly constrained to move along the stanchion races 117, 118 in the gap 120 between the stanchion members 114, 115. Hand grips 126 and 128 may be connected to the arm carriages 122, 124, respectively. Rollers or low friction material and the like may be utilized to facilitate the linearly constrained movement of the arm carriages 122, 124 along the stanchion races 117, 118.

Figure 6:
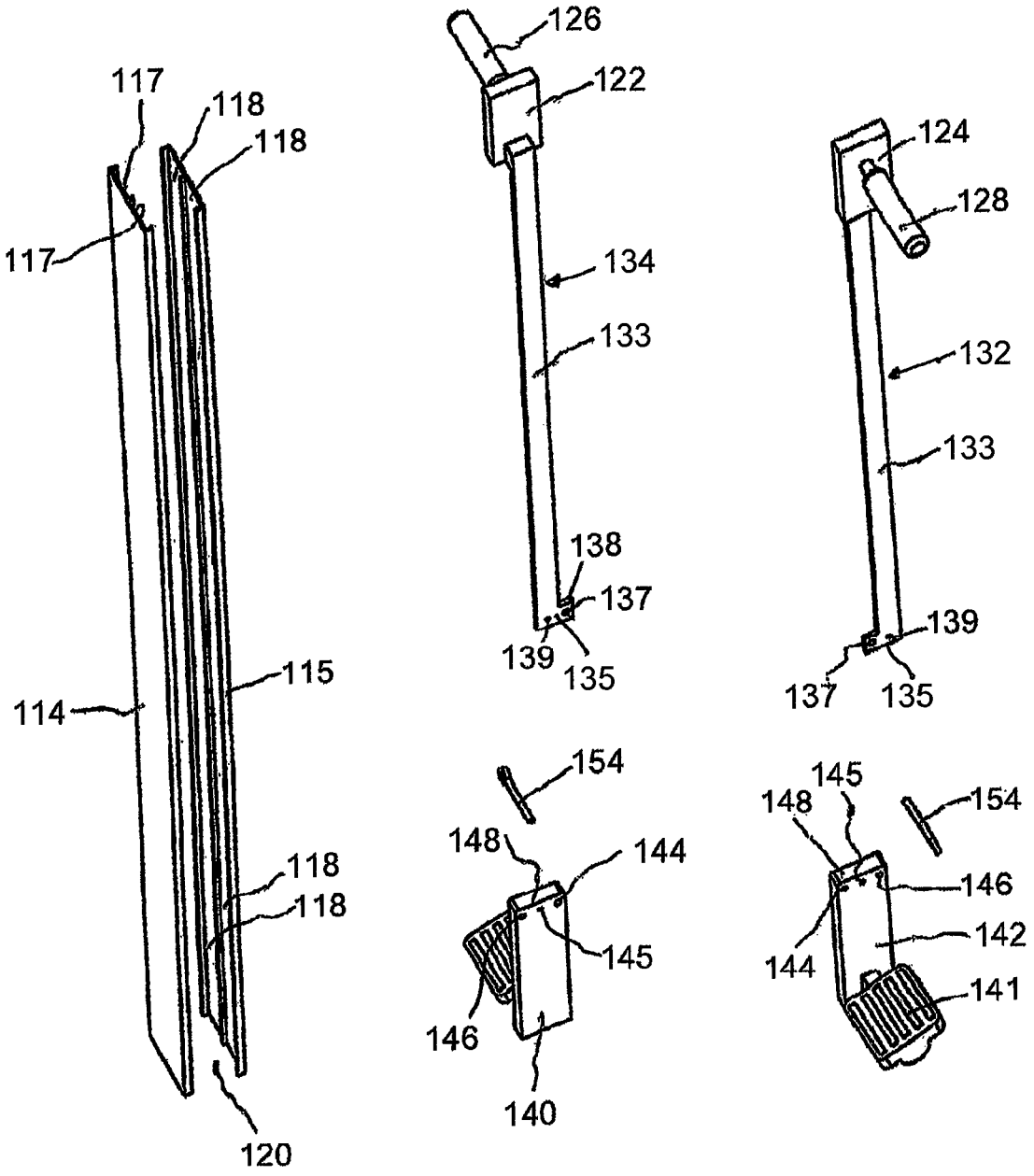
FIG. 6 is an exploded partial perspective view of elements of the climbing exercise apparatus shown in FIG. 1.

Foot support members 132 and 134 may extend downwardly from the arm carriages 122, 124, respectively (see FIG. 6). The foot support members 132, 134 may be fixedly secured to the arm carriages 122, 124. The foot support members 132, 134 may define right-angle structures comprising elongated vertical legs 133 and transverse legs 135. The transverse legs 135 may extend in opposite directions relative to one another. Through holes 137 and 139 may extend through the the transverse legs 135 of the foot support members 132, 134.

Foot carriages 140 and 142, linearly constrained to move along the stanchion races 117, 118 in the gap 120 between the stanchion members 114, 115, may be coupled to respective arm carriages 122, 124. The foot carriages 140, 142 may include spaced apart through holes 144, 145 and 146 aligned horizontally proximate the upper end 148 of the foot carriages 140, 142. Foot pedals 141 may be secured proximate the lower distal ends of the foot carriages 140, 142, generally in a non-adjustable manner but may be rotatably secured to the foot carriages 140, 142, if preferred.

Figure 5:
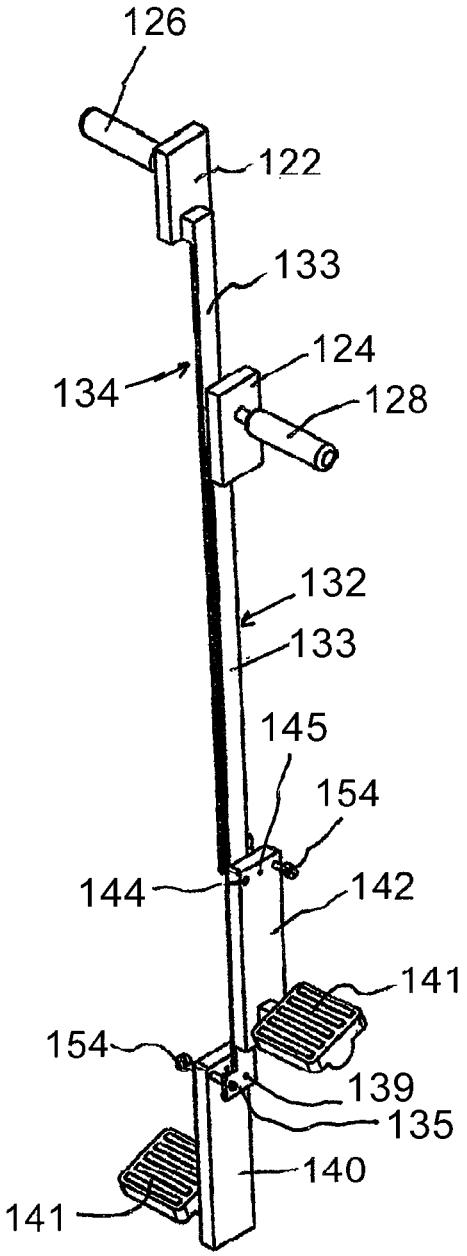
FIG. 5 is perspective view showing the reciprocating members of the climbing exercise apparatus of FIG. 1 configured in the cross climbing mode.

Means may be provided, such as but without limitation, a cable 150 or roller chain such that opposite and reciprocal motion may occur between arm carriages 122, 124 and foot carriages 140, 142. The user may set the exercise mode of the climbing exercise apparatus 100 to straight climbing or cross climbing and vice versa. To facilitate a change in the climbing mode of the climbing exercise apparatus 100, the foot carriages 140, 142 may be leveled (equal height above the floor) relative to one another, best shown in FIG. 3, so that through holes 139 of the transverse legs 135 of the support members 132, 134 align with the through holes 145 of the foot carriages 140, 142. A temporary alignment pin 152 may be inserted through the aligned holes 139 and 145 to temporarily secure the foot carriages 140, 142 to the foot support members 132, 134. To configure the climbing exercise apparatus 100 for homolateral or straight climbing, lock pins 154 may be inserted through holes 144 of the foot carriages 140, 142 and holes 137 of the transverse legs 135, thereby securing foot carriage 142 to foot support member 132 and foot carriage 140 to foot support member 134, shown in FIG. 4. To configure the climbing exercise apparatus 100 for contralateral or cross climbing, shown in FIG. 5, the lock pins 154 may be inserted through holes 146 of the foot carriages 140, 142 into holes 137 of opposite transverse legs 135, thereby securing foot carriage 140 to foot support 132 and foot carriage 142 to foot support 134.

Figure 7:
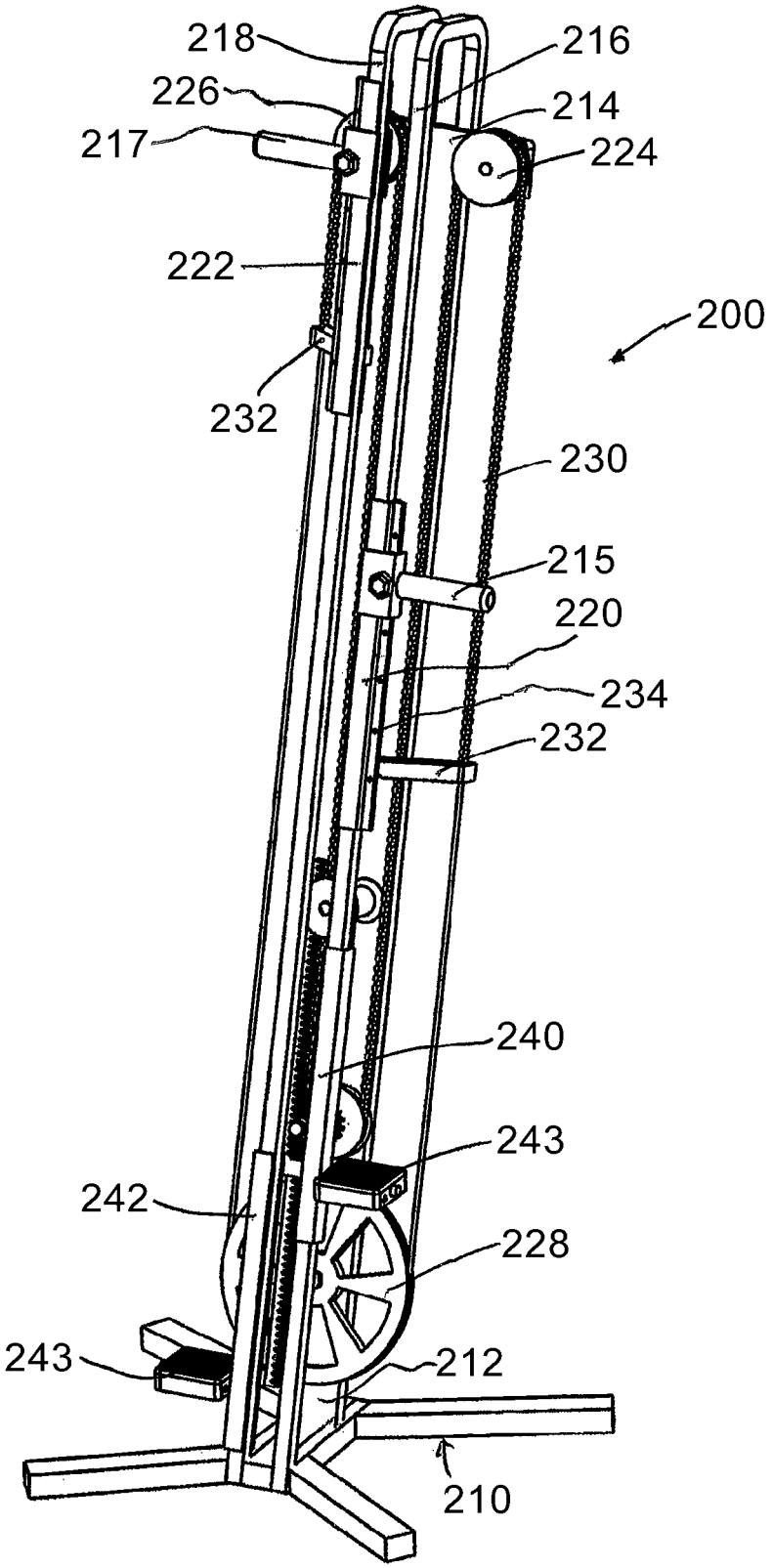
FIG. 7 is a perspective view of a second embodiment of a climbing exercise apparatus.
Figure 8:
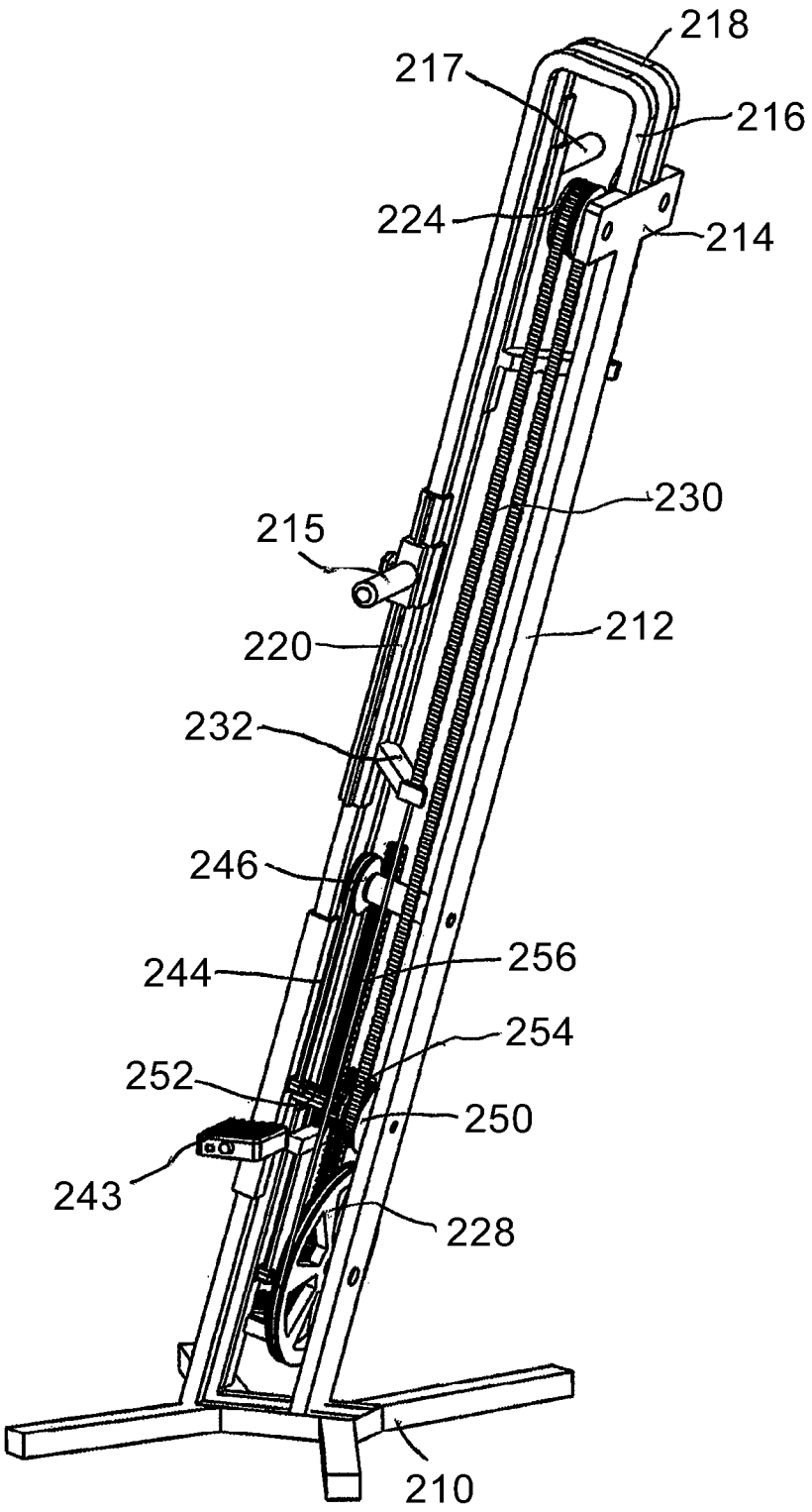
FIG. 8 is a side perspective view of the climbing exercise apparatus shown in FIG. 7.
Figure 9:
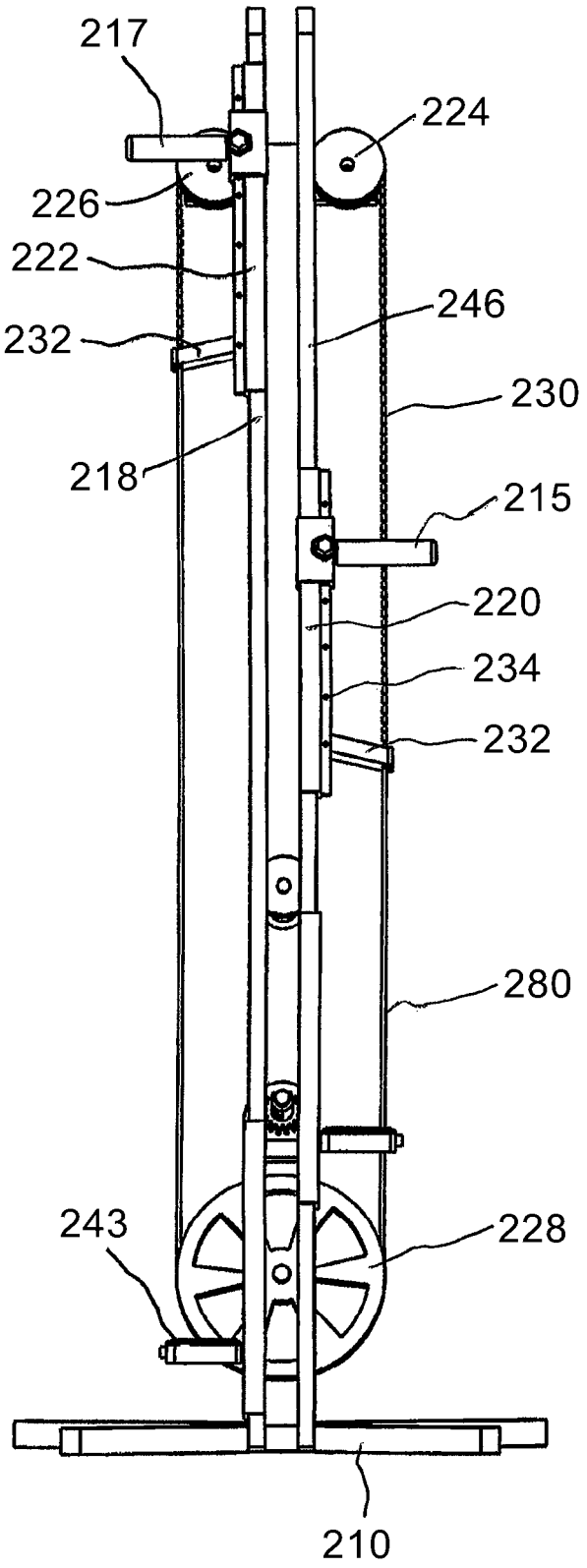
FIG. 9 is a front view of the climbing exercise apparatus shown in FIG. 7.
Figure 10:
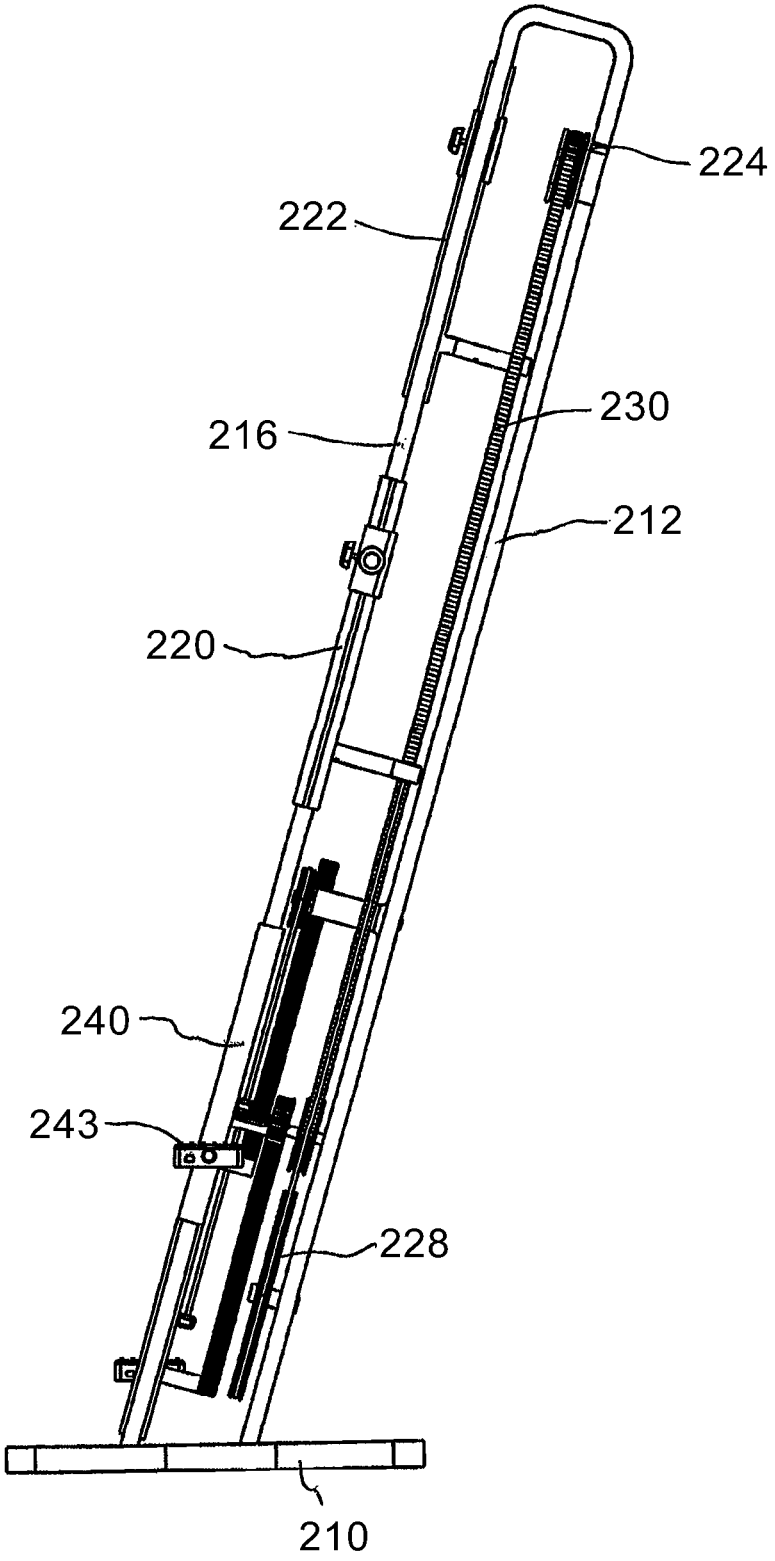
FIG. 10 is a side view of the climbing exercise apparatus shown in FIG. 7.
Figure 11:
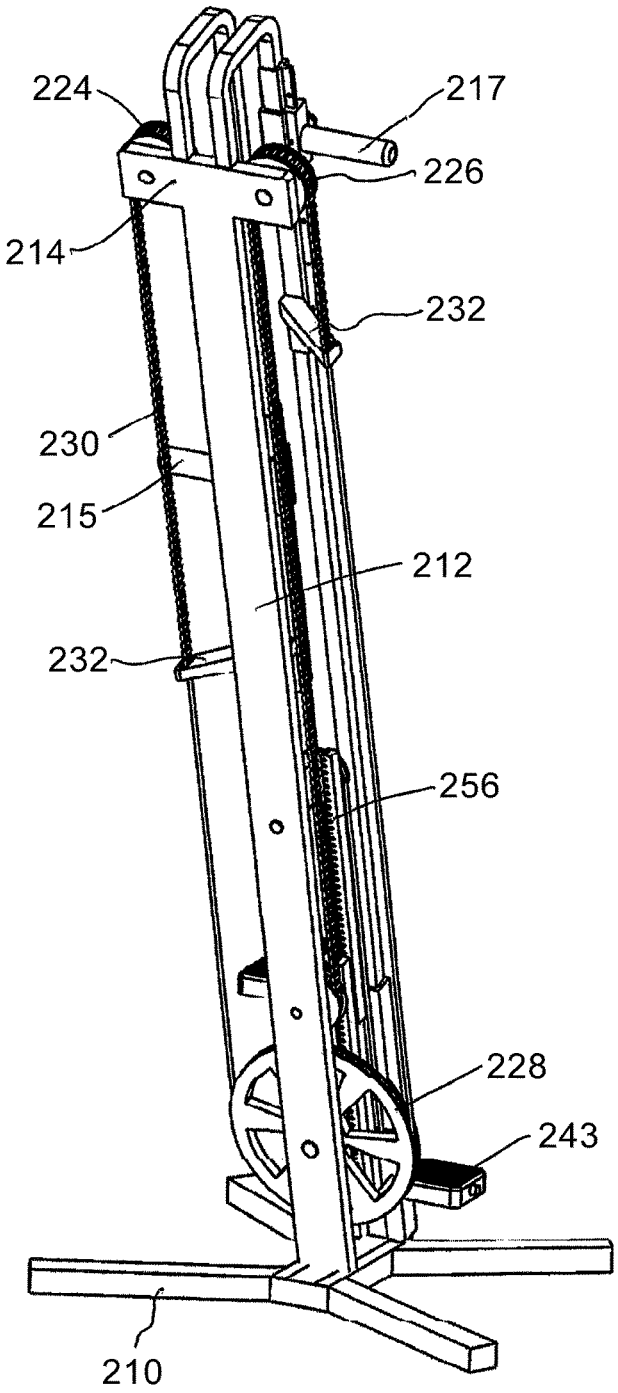
FIG. 11 is a rear perspective view of the climbing exercise apparatus shown in FIG. 7.

Referring now to FIGS. 7-9, a second embodiment of a climbing exercise apparatus is generally identified by the reference numeral 200. The climbing exercise apparatus 200 may include a base 210 adapted for resting on a substantially flat surface, such as but without limitation, a floor. A stanchion 212 may be fixedly secured to the base 210. The stanchion 212 may extend generally vertically upward from the base 210. A cross member 214, integrally formed with the stanchion 212 or separately bolted or otherwise secured to the upper end of the stanchion 212, may extend transverse to the longitudinal axis of the stanchion 212. The upper end of the stanchion 212 may define a T-shaped profile where portions of the cross member 214 project from the stanchion 212 in opposite directions.

A pair of guide members 216 and 218 may include upper ends fixedly secured to the upper end of the stanchion 212. The guide members 216, 218 may be spaced apart from one another and may extend substantially parallel to the stanchion 212. The guide members 216, 218 may be fixedly secured to the base 210 spaced from and in front of the stanchion 212.

Arm carriages 220 and 222 may be slidably secured to respective guide members 216, 218. Hand grips 215 and 217 may be connected to the arm carriages 220, 222, respectively. The arm carriages 220, 222 may be linearly constrained to move along the guide members 216, 218 in a generally vertical reciprocal motion. A pair of pulleys 224 and 226 may be rotatably secured to the cross member 214. A larger pulley 228 may be rotatably secured proximate the lower end of the stanchion 212. A cable 230 or roller chain may be utilized to provide reciprocal or oppositional dependent movement of the arm carriages 220, 222. The cable 230 may be routed over the pulleys 224, 226 and the pulley 228. Links 232 projecting from the arm carriages 220, 222 may connect the arm carriages 220, 222 to the cable 230. The ends of the links 232 may be crimped or otherwise secured to the cable 230.

The arm carriages 220, 222 may include a plurality of openings or holes 234 along the length thereof. The position of the hand grips 215, 217 may be adjusted along the arm carriages 220, 222 to accommodate the height of a user by detaching the hand grips 215, 217 from the arm carriages 220, 222 and reattaching them at openings 234 at a different height.

Foot carriages 240 and 242 may be slidably secured to respective guides 216, 218. Foot or pedals 243 may be secured proximate the lower distal ends of the foot carriages 240, 242, generally in a non-adjustable manner but may be rotatably secured to the foot carriages 240, 242, if preferred. A second cable 244 or roller chain may be utilized to provide reciprocal or oppositional dependent movement of the foot carriages 240, 242. The cable 244 may be routed over an intermediate pulley 246 secured to the stanchion 212 and the distal ends thereof secured to respective foot carriages 240, 242.

A contact roller 250 may be secured to an axle 252 which is rotatably secured to the stanchion 212. The roller 250 may engage the large pulley 228. A portion of the cable 230 may be routed over the roller 250. A gear 254 concentric with the roller 250 may be secured to the axle 252. The gear 254 may be in operative engagement with a linear rack with teeth 256 secured to the foot carriages 240, 242.

While preferred embodiments of the invention have been shown and described, other and further embodiments of the invention may be devised without departing from the basic scope thereof, and the scope thereof is determined by the claims which follow.

The invention claimed is:

1. A climbing exercise apparatus, comprising:

a) a frame including a base configured to rest on a flat surface;

b) a left arm carriage and a right arm carriage movably supported by said frame;

c) rigid left leg member and a rigid right leg member fixedly secured to respective said left arm carriage and said right arm carriage, and further including spaced apart through holes proximate to a distal end of said left leg member and said right leg member; and d) a left foot carriage and a right foot carriage selectively coupled to a respective said rigid left leg member and said rigid right leg member to perform homolateral and contralateral climbing exercise movements.

2. The climbing exercise apparatus of claim 1 wherein said frame includes a vertically extending stanchion fixedly secured to said base, said vertically extending stanchion including spaced apart stanchion members wherein each of said spaced apart stanchion members include a pair of longitudinal stanchion races.

3. The climbing exercise apparatus of claim 2 wherein said left arm carriage and right arm carriage and said left foot carriage and right foot carriage are constrained to move along said pair of longitudinal stanchion races.

4. The climbing exercise apparatus of claim 1 including a foot pedal secured to each said left foot carriage and said right foot carriage.

5. The climbing exercise apparatus of claim 1 further including lock pins for connecting said left foot carriage and said right foot carriage to a respective said rigid left leg member and said rigid right leg member.

6. The climbing exercise apparatus of claim 1 further including lock pins, wherein said lock pin connects pins connect said left foot carriage to said left arm carriage and said right foot carriage to said right arm carriage for performing homolateral climbing exercise movements.

7. The climbing exercise apparatus of claim 1 further including lock pins, wherein said lock pins connect said left foot carriage to said right arm carriage and said right foot carriage to said left arm carriage for performing contralateral climbing exercise movements.

8. The climbing exercise of claim 1 further including an alignment pin temporarily locking said left foot carriage and said right foot carriage in alignment relative to one another.

9. A climbing exercise apparatus, comprising:

a) a frame including a base and a vertically extending stanchion fixedly secured to said base;

b) a left arm carriage and a right arm carriage movably supported by said stanchion;

c) left and right hand grips coupled to respective said left arm carriage and said right arm carriage;

d) a rigid left foot support member and a rigid right foot support member fixedly secured to respective said left arm carriage and said right arm carriage, and further including spaced apart through holes proximate to a distal end of each said rigid left foot support member and said rigid right foot support member;

e) a left foot carriage and a right foot carriage selectively coupled to a respective said left foot support member and said right foot support member for performing homolateral and contralateral climbing exercise movements; and f) a foot pedal fixedly secured to each said left foot carriage and said right foot carriage.

10. The climbing exercise apparatus of claim 9 further including lock for pins connecting said left foot carriage and said right foot carriage to a respective said left foot support member and said right foot support member.

11. The climbing exercise apparatus of claim 9 wherein said left and right arm carriages and said left and right foot carriages are constrained to move along said stanchion.

12. The climbing exercise of claim 9 including an alignment pin temporarily locking said left foot carriage and said right foot carriage in alignment relative to one another.

* * * * *